US009210492B2

(12) United States Patent
Dave et al.

(10) Patent No.: US 9,210,492 B2
(45) Date of Patent: Dec. 8, 2015

(54) MICROPHONE ASSEMBLY HAVING AN ACOUSTIC COUPLER

(75) Inventors: Ruchir M. Dave, San Jose, CA (US); Sawyer Isaac Cohen, Sunnyvale, CA (US); Christopher Wilk, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 820 days.

(21) Appl. No.: 13/283,506

(22) Filed: Oct. 27, 2011

(65) Prior Publication Data

US 2013/0108082 A1 May 2, 2013

(51) Int. Cl.
*H04R 25/00* (2006.01)
*H04R 1/08* (2006.01)

(52) U.S. Cl.
CPC ..... *H04R 1/086* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 7,825,509 | B1 | 11/2010 | Baumhauer et al. | |
| 2003/0063762 | A1 | 4/2003 | Tajima et al. | |
| 2005/0094832 | A1 * | 5/2005 | Song et al. | 381/174 |
| 2007/0189568 | A1 * | 8/2007 | Wilk et al. | 381/355 |
| 2007/0238495 | A1 | 10/2007 | Hawker et al. | |
| 2008/0152183 | A1 | 6/2008 | Janik et al. | |
| 2009/0245564 | A1 | 10/2009 | Mittleman et al. | |
| 2011/0059348 | A1 * | 3/2011 | Rothkopf et al. | 429/122 |
| 2011/0170728 | A1 * | 7/2011 | Chen | 381/365 |
| 2012/0177237 | A1 * | 7/2012 | Shukla et al. | 381/332 |

* cited by examiner

*Primary Examiner* — Joseph Saunders, Jr.
*Assistant Examiner* — James Mooney
(74) *Attorney, Agent, or Firm* — Brownstein Hyatt Farber Schreck, LLP

(57) ABSTRACT

Embodiments of the invention include a microphone assembly having a microphone soldered on a bottom side of a bottom ported microphone flex circuit carrier, and a rigid coupler soldered on the top side of the carrier, opposite to the microphone. The coupler is inserted into and sealed to a microphone boot made out of a soft material. The top of the boot may be sealed to an electronic audio device into which the assembly is integrated. Acoustic openings through the housing, boot, coupler and carrier allow acoustic signals to reach the microphone. However, the seals between the housing, boot, coupler, carrier and microphone provide sound isolation, as well as a moisture and dust seal between the ambient and the inside of the electronic device. Such seals may include rings, grooves, threads, O-rings between the boot and coupler; or a reinforcing ring around the soft material of the boot.

23 Claims, 8 Drawing Sheets

MICROPHONE ASSEMBLY HAVING AN ACOUSTIC COUPLER

Embodiments of the invention relate to microphone assemblies, particularly those that are integrated within an electronic audio device such as a mobile phone, tablet computer, notebook computer or desktop computer.

BACKGROUND

In the field of electronic audio devices such as personal computers, laptop computers, tablet computers, and smart phones (e.g., a typical mobile phone such as an iPhone™ device by Apple Inc., of Cupertino Calif.), microphones are used to sense speech and other audio signals. The audio signals are converted to electronic signals, such as for communicating by phone, or making audio recordings. The device typically has a housing with an acoustic aperture or opening through which audio signals reach a microphone assembly that includes the microphone.

However, ambient moisture and dirt may enter the device through the opening or through the assembly. This may cause problems for the microphone or other circuitry of the device. For example, this may cause the microphone or other circuitry of the device to fail or become unusable. In addition, stray or unwanted sound in the ambient and vibration of the housing can effect the microphone assembly. In some situations, this may cause feedback or cause the microphone circuitry to otherwise become unusable for converting verbal input by the user into electronic audio signals.

SUMMARY

Embodiments of the invention include a microphone assembly having a microphone bonded to a bottom side of a printed circuit carrier. The microphone's acoustic input port is aligned with a port thought the carrier and a rigid coupler is bonded to the top side of the carrier, opposite to the microphone. An opening through the coupler is aligned with the other side of the carrier port. The coupler is inserted into and sealed to a microphone boot made out of a soft material. An opening through the boot is aligned with the opening through the coupler. The top of the boot may be bonded to a housing of an electronic audio device such as a mobile phone, tablet computer, notebook computer or desktop computer into which the assembly is integrated. The openings through the housing, boot, coupler and carrier allow acoustic signals in the ambient to reach the microphone. However, seals between the housing, boot, coupler, carrier and microphone provide sound isolation, as well as a dust and moisture-tight seal between the ambient and other components within the electronic device. For example, seals between the boot and coupler may include rings in an inner perimeter of the boot that engage grooves in an outer perimeter of the coupler, one large ring around the upper outer perimeter of the coupler to engage a large groove in the boot inner perimeter, threads around the outer perimeter of the coupler to engage threads in the boot, an O-ring in a groove of the coupler to engage the flat surface of the boot, a metal reinforcing ring around and interlocked to the soft material of the boot, a metal reinforcing ring within and interlocked to the soft material of the boot, or a reinforcing hard material ring around the outer base of the soft material boot.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Microphone assemblies are often integrated within electronic audio devices such as mobile phones, tablet computers, notebook computers and desktop computers to detect audio signals (e.g., sound). However, ambient moisture and dirt (e.g., dust) may enter the electronic device due to gaps through components of the assembly or through the acoustic apertures (e.g., openings) of the assembly, and may cause the microphone or other circuitry within the device to fail or have reduced functionality. Thus, it can be important to provide a microphone assembly that has sound isolation, and a moisture and dirt tight seal between the ambient and spaces, components and circuitry inside the housing of the electronic device. For example, a microphone assembly may be designed with proper sealing technology between the device housing, components of the assembly and the microphone to provide sound isolation, as well as a moisture, dust and air-tight seal between the ambient and the inside of the electronic device.

Figure 1:
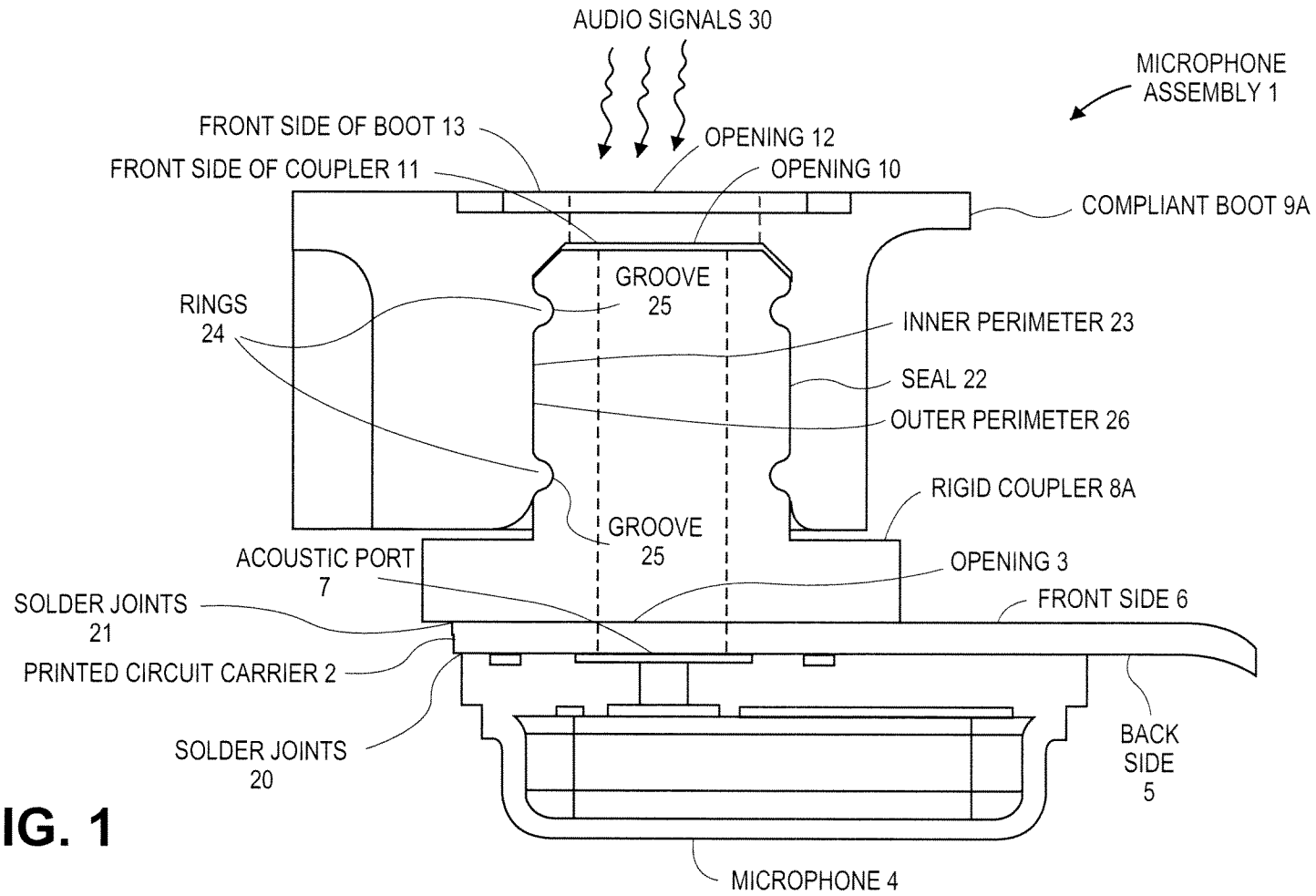
FIG. 1 is a side view of one type of microphone assembly.

More specifically, FIG. 1 shows one type of such a microphone assembly. Microphone assembly 1 includes printed circuit carrier 2 (PCC) having opening 3 (e.g., an acoustic aperture) through the carrier. Microphone 4 is attached to and facing back side 5 of the carrier 2, such as by having its input acoustic port 7 (or its transducer) facing and open to the surface of back side 5. The microphone has acoustic input port 7 aligned with the opening 3, such as by having the axis of port 7 aligned or parallel to the axis of opening 3. Port 7 may also be described as facing and open to opening 3.

FIG. 1 also shows coupler 8A attached to and facing front side 6 of the carrier 2, such as by having its opening 10 facing and open to the surface of front side 6. The rigid acoustic coupler 8A has opening 10 through the coupler 8A and aligned with the opening 3. The coupler has its opening 10 aligned with the opening 3, such as by having opening 10 facing and open to opening 3. Compliant boot 9A is installed over the rigid acoustic coupler 8A. Compliant boot 9A has opening 10 through the boot and aligned with opening 3. Opening 10 extends from the front side 11 of the coupler to opening 3, and opening 12 extends from the front side 13 of boot 9A to opening 10.

Printed circuit carrier 2 may be a "flex" circuit carrier, a microphone flex circuit board, a flexible circuit, a printed circuit board (PCB), and/or a printed circuit carrier. Such a carrier may include signal and other traces on (and possibly in) a flexible material (e.g., PCB material). A "flex" circuit carrier may include a flexible plastic substrate, such as polyimide, PEEK or a transparent conductive polyester film. It may also include screen printed technology, photolithographic technology, metal strips laminated between two layers of PET, and/or technology used to manufacture components of rigid PCBs. It may allow the carrier to conform to a desired shape, or to flex during its use. It may also include solder around a perimeter of opening 3 on sides 5 and 6, contacts and signal traces for connecting the microphone to audio processing circuitry.

Microphone 4 may be a MEMS (MicroElectrical-Mechanical System) microphone, such as a microphone chip or silicon microphone. In some cases, microphone 4 may use a field effect transistor or amplification system to amplify a sensed signal in the audio range, such as from a human voice.

Rigid acoustic coupler 8A may be made of or may include a metal material such nickel, iron, bronze, copper, aluminum, or steel). In some cases, coupler 8A is a metal cap of one metal plated with another. It is considered that coupler 8A may be a metal cap of nickel plated steel.

Compliant boot 9A may be made of or may include a soft compression molded material. In some cases, boot 9A is made of a soft compression molded silicon, rubber, or polymer.

Carrier 2, microphone 4, coupler 8A and boot 9A may be described as components of assembly 1. Gaps through the components, between the ambient (e.g., moisture, dirt and possibly air) and the inside of a device the assembly is integrated into can be avoided by ensuring appropriate seals and bonds between components. For instance, the assembly may have seals (e.g., moisture, dirt and possibly air) between its acoustic apertures (e.g. holes or openings between the ambient and the microphone input port) and the inside of the device. The assembly may also be sealed to an acoustic aperture of the housing of the device, under which the assembly is located. The components and seals may also provide sound isolation from stray or unwanted sound in the ambient and vibration of the housing.

To provide such seals, FIG. 1 shows an embodiment having microphone 4 bonded to back side 5 of the carrier, such as using glue, adhesive, solder, or by being otherwise joined. In some cases, microphone 4 is soldered to back side 5 of the carrier. For example, a solder seal may be formed between microphone 4 and back side 5 around a perimeter of opening 3 so that the microphone is sealed to carrier 2. A perimeter may have various shapes such as a circle, oval, square, rectangle, etc. Such a seal may include being sealed with respect to air and dust; and being sound isolated (e.g., providing substantial sound isolation, muffling or deadening) with respect to stray or unwanted sound in the ambient and vibration of the housing. In some cases, the solder may hold the microphone 4 with enough force (e.g., tight enough) against back side 5 to form such a seal, even though the solder may not form a complete perimeter. The acoustic input port of microphone 4 may be described as aligned with and adjoining opening 3. In some embodiments, microphone 4 is disposed entirely behind or below a surface of back side 5 of carrier 2 and does not extend within opening 3. It is also considered that microphone 4 may be contained within an encasement or housing that is outside and behind back side 5 of carrier 2, and external to opening 3.

The seals may also include coupler 8A being bonded to front side 6 of the carrier, such as using glue, adhesive, solder, or by being otherwise joined. In some cases, coupler 8A is soldered to front side 6 of the carrier. For example, a solder seal may be formed between coupler 8A and front side 6 around a perimeter of opening 3 so that the coupler is sealed to carrier 2. Such a seal may include being sealed with respect to air and dust; and being sound isolated (e.g., providing substantial sound isolation, muffling or deadening) with respect to stray or unwanted sound in the ambient and vibration of the housing. In some cases, the solder holds the coupler 8A with enough force against front side 6 to form such a seal, even though the solder may not form a complete perimeter. In some embodiments, coupler 8A is disposed entirely in front of or above a surface of front side 6 of carrier 2 and does not extend within opening 3.

The bonding between microphone 4 and back side 5 and/or the bonding between coupler 8A and front side 6 may be or include of one or more different or repeated bonding techniques (e.g., overlapping solder joints). In some cases, such bonding includes other material such as signal traces, adhesive, solder, and/or tape between surfaces of microphone 4 and back side 5 and/or between surfaces of coupler 8A and front side 6. In some cases, microphone 4 is secured to and sealed to the back side of carrier 2 by a soldering process or glue; and coupler 8A is secured to and sealed to the front side of carrier 2 by a soldering process or glue.

In some embodiments, the solder between microphone 4 and back side 5 and/or the solder between coupler 8A and front side 6 does not conduct signals to any circuitry of the device. It is considered that the solder may be grounded to help reduce unwanted electronic effects or signals due to the existence of the solder. In some cases, such solder includes at least one bias or signal path, to or from the microphone, in addition to the bonding solder. In some cases, such solder includes exposed metal traces to which microphone 4 and back side 5 and/or coupler 8A and front side 6 are bonded.

Compliant boot 9A may be sealed (vial seal 22) to acoustic coupler 8A by mechanical friction and/or mechanical structure. This seal may be caused by the material and shape of inner perimeter 23 of boot 9A nominally interfering with outer perimeter 26 of coupler 8A along one or more discrete paths to ensure a dirt and moisture tight seal. Such paths may be formed by surfaces of rings nominally interfering with (e.g., causing friction when moved with respect to) with corresponding surfaces of corresponding grooves. In some cases, the seal includes at least one ring in an inner perimeter of the boot that engages at least one groove in an outer perimeter of the coupler (e.g., see FIGS. 1 and 2), at least one large ring around the upper outer perimeter of the coupler boot to engage a large groove in the boot inner perimeter, at least one thread around the outer perimeter of the coupler to engage threads in the boot (e.g., see FIGS. 3A-B), at least one O-ring in a groove of the coupler to engage the flat surface of the boot (e.g., see FIG. 4), a metal reinforcing ring around and interlocked to the soft material of the boot (e.g., see FIGS. 5A-B), a metal reinforcing ring within and interlocked to the soft material of the boot (e.g., see FIGS. 6A-B), or a reinforcing hard material ring around the outer base of the soft material boot (e.g., see FIGS. 7A-B).

In some embodiments, such as shown in FIG. 1, coupler 8A is or includes a metal cap; boot 9A is or includes a soft compression molded material; and an inner perimeter of the compliant boot is sealed to an outer perimeter of the coupler, where the seal includes using rings (e.g., in the boot or coupler) that engage (e.g., mate with) grooves (e.g., in the coupler or boot). It can be appreciated that there may be 1, 2, 3, 4, or more rings to provide some of the seal. In some cases only 1 or 2 rings may be needed.

For example, as shown in FIG. 1, compliant boot 9A has inner perimeter 23 having rings 24 that engage or mate with corresponding grooves 25 in outer perimeter 26 of the coupler to from a dirt and moisture (an possibly air) tight seal between the boot and the coupler (e.g., by sealing inner perimeter 23 to outer perimeter 26). Rings 24 may be ring shaped protrusions that extend outward from the outer perimeter along a ring around the perimeter. They may extend out to form a half circle or semi-circular cross section shape with respect to the path of the ring around the perimeter. It is considered that they may also extend out to form other curved or angled cross section shapes. For example, they may extend out to form an arc, an arch, a half oval, a sine wave bump, a Gaussian curve bump, or other protruding shapes with curved surface and/or flat surfaces shape cross section with respect to the path. Grooves 25 may extend inward along the inner perimeter in a shape that is the same as (e.g., receives) the ring shape (e.g., with respect to the path of the ring around the perimeter). Also, some other embodiments may have grooves in boot 9A inner perimeter 23, and corresponding rings in outer perimeter 26 of the coupler to from a dirt and moisture (and possibly air) tight seal between the boot and the coupler. In some embodiments, the rings do not necessarily engage grooves to from a dirt and moisture (and possibly air) tight seal between the boot and the coupler, such as embodiments including the rings in the boot, without the grooves in the coupler to mate into, or embodiments that have rings in the coupler but not grooves in the boot.

The compliance of the material of boot 9A and of coupler 8A may be selected so to ensure a seal between the boot and the coupler. The number of rings and grooves, thickness and height of the rings, and thickness and height of the grooves may also be selected so to ensure a seal between the boot and the coupler.

In some cases, a mechanical friction seal 22 (e.g., by the rings and grooves; or by other similar structure) may be formed between boot 9A and coupler 8A around perimeters 23 and 26 so that the boot is sealed to the coupler. Such a seal may include being sealed with respect to air and dust; and being sound isolated (e.g., providing substantial sound isolation, muffling or deadening) with respect to stray or unwanted sound in the ambient and vibration of the housing. In some cases, the mechanical friction holds the boot 9A with enough force against coupler 8A to form such a seal. For example, this may occur, even though the rings, thread, and/or grooves do not form (e.g., do not exist, or exist but do not form) a complete seal around a complete perimeter. In some embodiments, glue or adhesive may help the seal between compliant boot 9A and acoustic coupler 8A. Similar concepts apply to embodiments described below for FIGS. 2-7.

Figure 2:
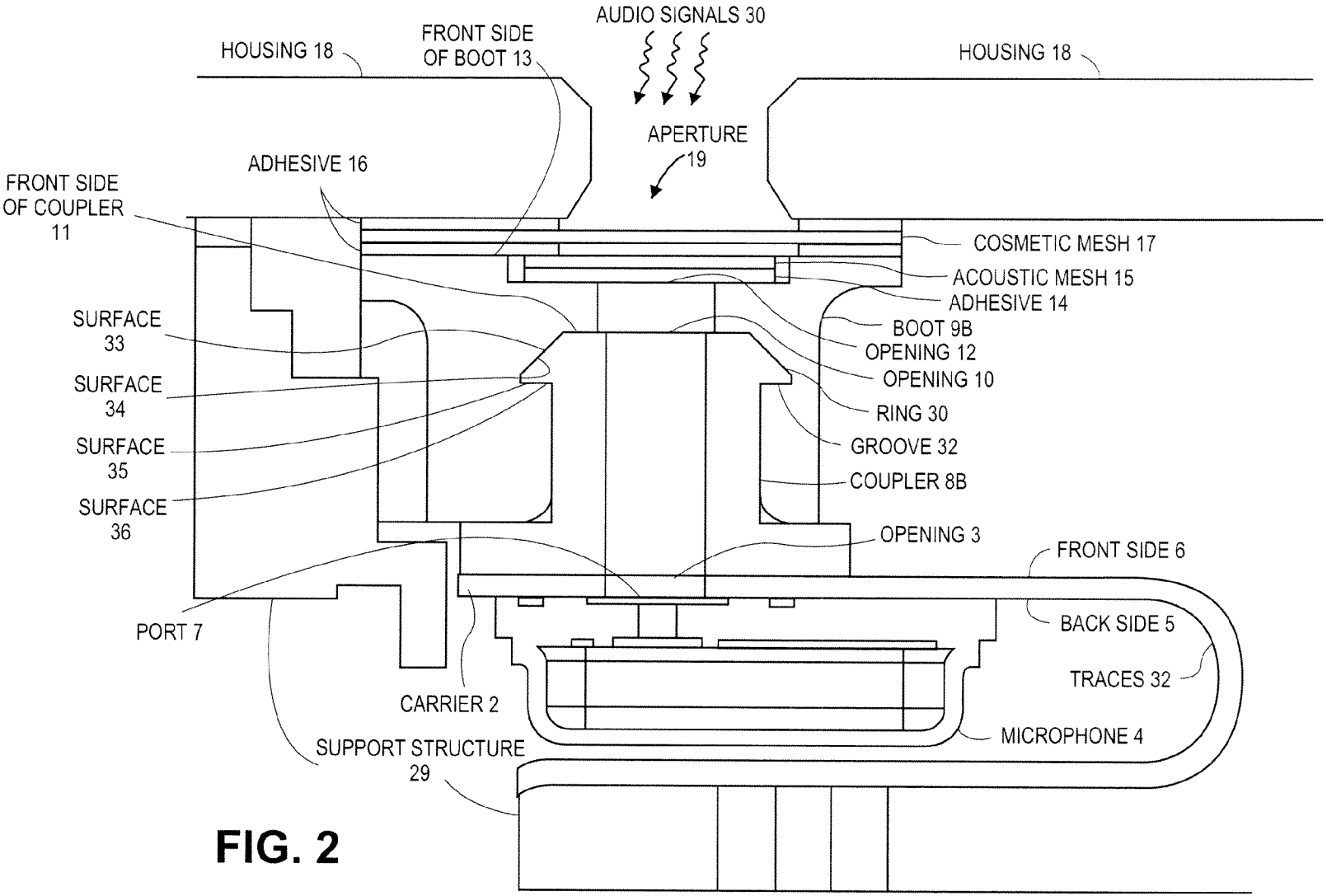
FIG. 2 is a side view of another type of microphone assembly, and includes parts of an electronic device the assembly is integrated into.

FIG. 2 is a side view of another type of microphone assembly, and includes parts of an electronic device the assembly is integrated into. For instance, FIG. 2 shows a housing 18 and support structure 29 of an electronic device in which assembly 1 is mounted or contained. Although some similar feature numbers are used for FIGS. 1 and 2, there is a distinction between the engaging or mating of coupler 8B and boot 9B of FIG. 2 as compared to coupler 8A and boot 9A of FIG. 1. Thus, descriptions above for coupler 8A and hoot 9A may apply to coupler 8B and boot 9B, such as with the exceptions of the differences described below. For example, as compared to rings 24 and grooves 25 of coupler 8A and boot 9A in FIG. 1, in embodiments shown in FIG. 2, coupler 8B has an outer perimeter with one large ring or disc shape 30 that engages or mates with one corresponding groove 32 in the inner perimeter of compliant boot 9B. This may from a dirt and moisture (and possibly air) tight seal between the boot and the coupler (e.g., by sealing inner perimeter 23 to outer perimeter 26). In some embodiments, groove 32 has at least two flat surfaces that engage and seal to corresponding flat surfaces in ring 30. More particularly, flat surfaces 33 and 35 of ring 30 may be nominally interfering with (e.g., causing friction when moved with respect to) with corresponding flat surfaces 34 and 36 of groove 32.

In some cases, surfaces 33 and 35 may form a protrusion that extend outward from the outer perimeter along a ring around the perimeter. They may extend out to form an angled edge cross section shape with respect to the path of the ring around the perimeter, such as forming an angle of 45 degrees where they meet. It is considered that ring 30 may also extend out to form other curved or angled cross section shapes, such as noted above for ring 24. Surfaces 34 and 36 may extend inward along the inner perimeter in a shape that is the same as (e.g., receives) the ring shape (e.g., with respect to the path of the ring around the perimeter).

FIG. 2 also shows an embodiment having boot 9B attached to device housing 18 (e.g., of a device such as device 50 of FIG. 8) with an adhesive 16, and opening 3 aligned with acoustic aperture 19 (e.g., a hole) of the housing. In some embodiments, cosmetic mesh 17 is disposed over opening 12, and is attached to front side 13 of the boot with adhesive 16. Cosmetic mesh 17 may provide a visually appealing look for aperture 19, such as by providing a noticeable location of the microphone assembly so that a user will know which part of the device to speak at or aim at audio signals the user desired to be picked up by the microphone.

Adhesive 16 may hold the boot in place vertically and horizontally so that a seal is formed between the boot front side 13 and the back side of housing 18. In some cases, the outer side surfaces of the boot are sealed horizontally to inner side surfaces of acoustic aperture 19 of housing 18, such as by adhesive. Such a seal may include being sealed with respect to air and dust; and being sound isolated (e.g., providing substantial sound isolation, muffling or deadening) with respect to stray or unwanted sound in the ambient and vibration of the housing. In some cases, the adhesive 16 holds the boot 9B with enough force against housing 18 to form such a seal, even though the adhesive may not form a complete perimeter. Boot may be described as being bonded to edges of aperture 19 of a mobile housing.

In accordance with embodiments, compliant boot 9B may not touch the printed circuit carrier 2. In some cases, boot 9B also touches or is attached (e.g., by adhesive and/or mechanical pressure) to support structure 29 within housing 18 or an electronic device.

Also, in some cases, acoustic mesh 15 is disposed under cosmetic mesh 17 and over opening 12, and is attached to front side 13 of the boot with adhesive 14. Acoustic 15 may provide physical audio filtering to help pass speech audio frequencies but filter out or mute frequency ranges above and below typical human speech. This way, undesired audio signals picked up by the microphone will not interfere with a user's speech received by the microphone.

This design allows audio signals 30 in the ambient or incident upon assembly 1 (e.g., opening 12) to be received by microphone 4 and converted into electronic audio signals. In some cases, audio signals incident upon the compliant boot and front side of the carrier are converted by the microphone into electronic signals. For example, assembly 1 (e.g., microphone 4) may be used to convert verbal input by a user (or other audio signals) into electronic audio signals. The microphone may be soldered to signal traces and/or circuitry of carrier 2 for processing the electronic signals. In some embodiments, microphone 4 is described as soldered and connected to through signal contacts on back side 5 of printed circuit carrier 2. Carrier 2 may be attached to housing 18, support structure 29, and/or to other internal components of an electronic device containing assembly 1 or into which the assembly is integrated (e.g., device 50 of FIG. 8). In some cases, carrier 2 is attached or bonded to support structure 29 within or inside housing 18 of an electronic device. Thus, analog audio electrical signals transmitted through the electrical traces of the printed circuit carrier may be stored and/or transmitted by an electronic device that includes assembly 1.

Figure 3B:
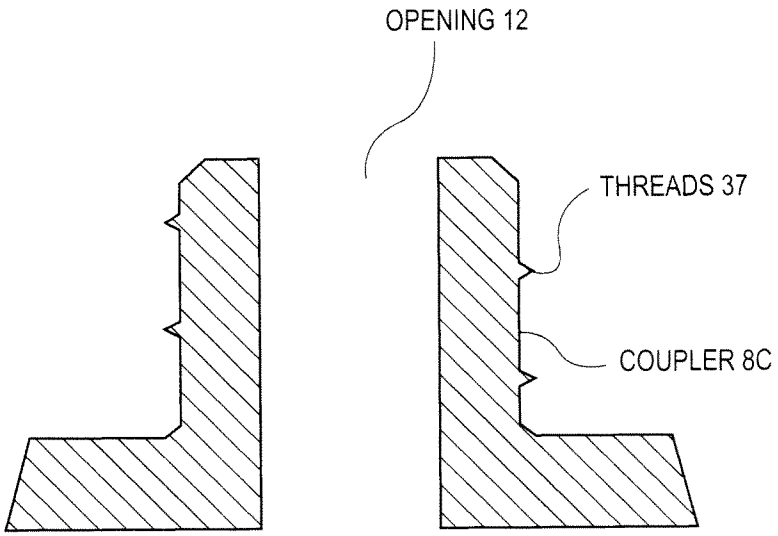
FIG. 3B is a cross-section view of FIG. 3A.
Figure 3A:
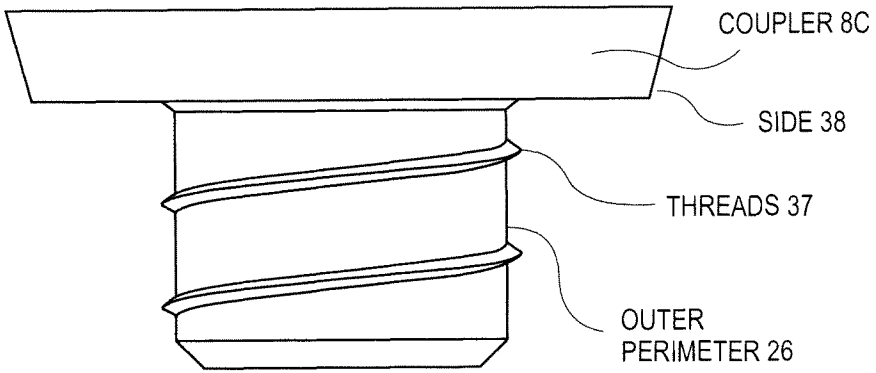
FIG. 3A is a side view of another type of coupler.

FIG. 3A is a side view of another type of coupler. FIG. 3B is a cross-section view of FIG. 3A. Although some similar feature numbers are used for FIGS. 1-3, there is a distinction between the engaging or mating of coupler 8C of FIG. 3 (e.g., and the boot) as compared to couplers 8A-B and boots 9A-B of FIGS. 1-2. Thus, descriptions above for couplers 8A-B and boots 9A-B may apply to coupler 8C and the boot, such as with the exceptions of the differences described below. For example, as compared to rings 24 and grooves 25 of coupler 8A and boot 9A in FIG. 1, and as compared to disc shape 30 and groove 32 of coupler 8B and boot 9B of FIG. 2, in embodiments shown in FIG. 3, coupler 8C has an outer perimeter 26 with threads 37 on the coupler that engage or screw into corresponding threads (e.g., grooves) in the inner perimeter of a hard boot (e.g., corresponding to boot 9A but with threaded grooves instead of rings 24). This may from a dirt and moisture (and possibly air) tight seal between the boot and the coupler (e.g., by sealing inner perimeter 23 to outer perimeter 26). In some embodiments, coupler 8C has at least two threads around it's perimeter that engage and seal to corresponding threads of the boot, such as by nominally interfering with (e.g., causing friction when moved with respect to) the corresponding threads. The number of threads, and thickness and height of the threads may be selected so to ensure a seal between the boot and the coupler.

FIGS. 3A-B also show that the bottom side(s) 38 of the coupler may be angled (e.g., forms an angle greater than 90 degrees) with respect to front side 6 of PCC2. Such an angle may be 100 degrees or some other angle between 95 and 105 degrees. In some cases, bottom side(s) 38 of the coupler may be have knurled surfaces for better bonding or attachment of the coupler with a solder joint to front side 6 of CCA 2, such as by providing a better solder interlock when soldering the coupler to the CCA. For instance, knurling can be added to the sides of the coupler to add mechanical strength to the joint between the coupler and CCA. Such knurling may be performed in a manufacturing process, such as using a lathe, to cut a diamond-shaped (criss-cross) pattern into the material of sides 38. The knurling may also be rolled into sides 38. This allows a better grip on the knurled object than would be provided by a smooth metal surface. In some cases, the knurled pattern is a series of straight ridges or a helix of "straight" ridges rather than a criss-cross pattern.

Figure 4:
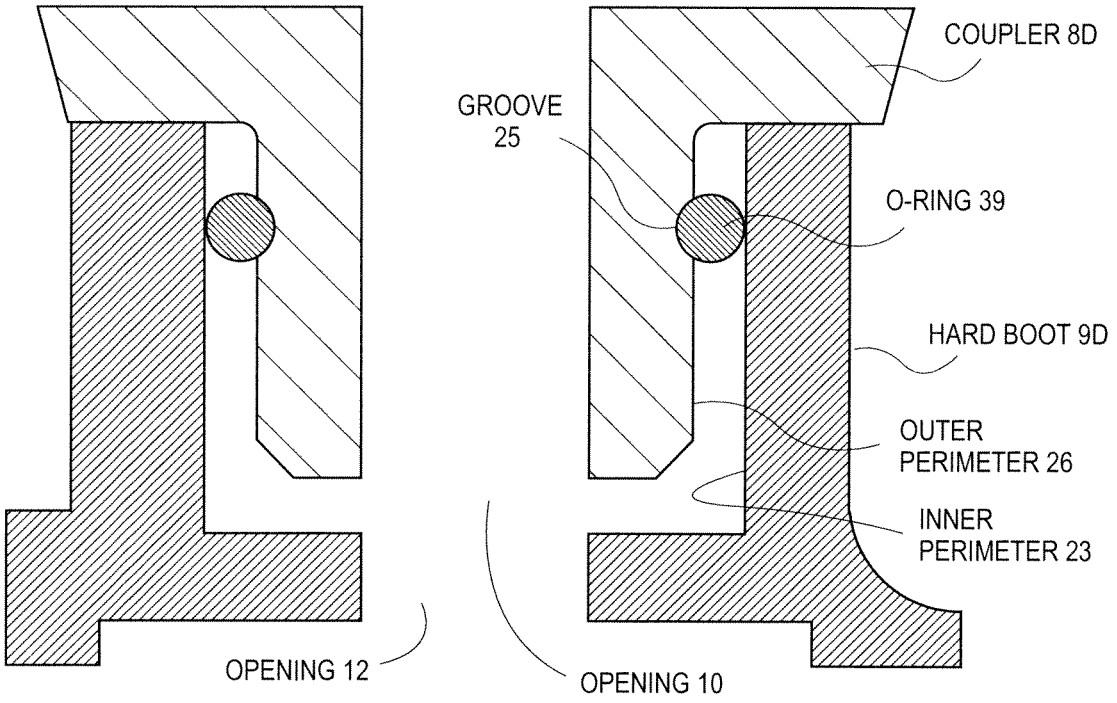
FIG. 4 is a cross-section view of another type of coupler and boot.

FIG. 4 is a cross-section view of another type of coupler and boot. Although some similar feature numbers are used for FIGS. 1-4, there is a distinction between the engaging or mating of coupler 8D and boot 9D of FIG. 4 as compared to couplers and boots of FIGS. 1-2. Thus, descriptions above for couplers 8A-B and boots 9A-B may apply to coupler 8D and boot 8D, such as with the exceptions of the differences described below. For example, as compared to rings 24 and grooves 25 in FIG. 1, and as compared to disc shape 30 and groove 32 of FIG. 2, in embodiments shown in FIG. 3, coupler 8D has an outer perimeter 26 with groove 25 and O-ring 39 on the coupler that engage or form a friction seal onto the surface (e.g., smooth) of the inner perimeter 23 of a hard boot 9D. This may from a dirt and moisture (and possibly air) tight seal between the boot and the coupler (e.g., by sealing inner perimeter 23 to outer perimeter 26). In some embodiments, coupler 8D has at least one O-ring 39 around it's perimeter that engages and seals to corresponding surface of the boot, such as by nominally interfering with (e.g., causing friction when moved with respect to) the corresponding surface.

Hard boot 9D may be made of or may include a metal material such as described above for coupler 8A. The compliance of the material of boot 9D, O-ring 39, and of coupler 8D may be selected so to ensure a seal between the boot and the coupler. The number of O-rings and grooves, thickness and height of the rings, and thickness and height of the grooves may also be selected so to ensure a seal between the boot and the coupler.

Figure 5A:
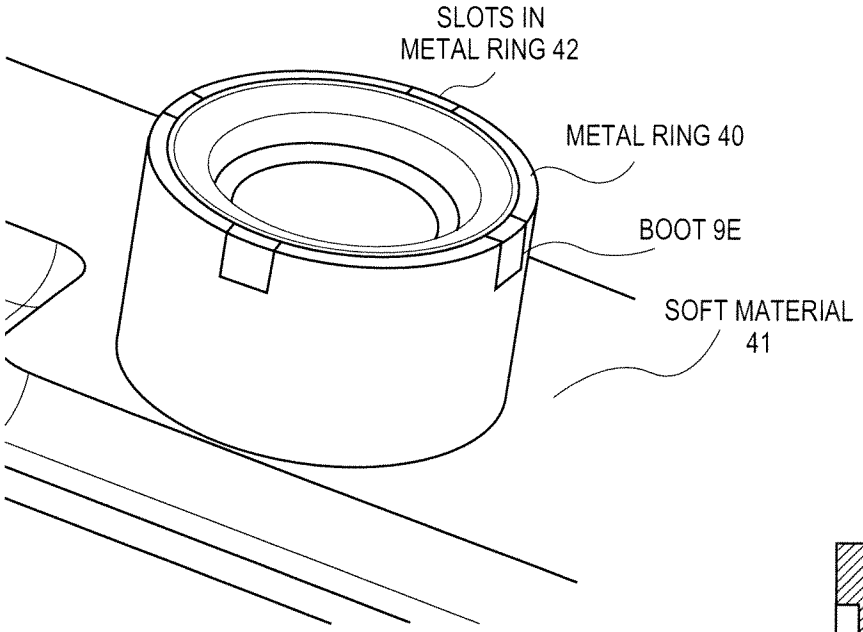
FIG. 5A is a perspective view of another type of boot.
Figure 5B:
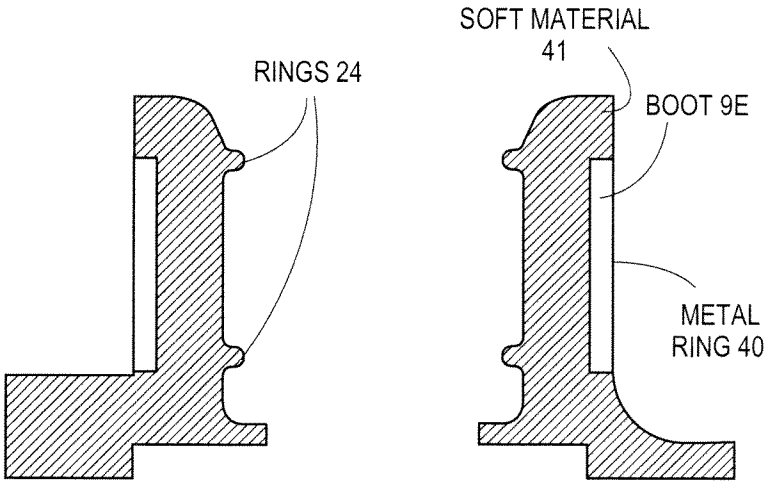
FIG. 5B is a cross-section view of FIG. 5A.

FIG. 5A is a perspective view of another type of boot. FIG. 5B is a cross-section view of FIG. 5A. Although some similar feature numbers are used for FIGS. 1-2, there is a distinction between the engaging or mating of boot 9E of FIGS. 5A-B (e.g., and the coupler) as compared to couplers and boots of FIGS. 1-2. Thus, descriptions above for couplers and boots of FIGS. 1-2 may apply to boot 9E and the coupler, such as with the exceptions of the differences described below. For example, as compared to rings 24 and grooves 25 in FIG. 1, and as compared to disc shape 30 and groove 32 of FIG. 2, in embodiments shown in FIGS. 5A-B, boot 9E includes a hard material, metal ring 40 that is overmolded on the inside surface of the ring (e.g., but not the outside surface of the ring) with soft material 41 that engage or form a friction seal onto the surface (e.g., smooth or grooved) of the outer perimeter of a hard coupler (e.g., coupler 8A). Boot 9E may also include rings 24, such as for engaging grooves 25 in a coupler as noted above. Ring 40 may have slots 42 that provide a rubber/metal interlock (e.g., attachment) between ring 40 and material 41 of the boot. Moreover, ring 40 may provide additional support, constriction towards, and resistance against expansion of the coupler, thus causing a tighter or more forceful seal (e.g., friction) between the boot and coupler. This may from a dirt and moisture (and possibly air) tight seal between the boot and the coupler (e.g., by sealing inner perimeter 23 to outer perimeter 26). In some embodiments, boot 9E has at least one ring around it's perimeter that engage and seal to the coupler, such as by increasing the nominal interference with (e.g., causing friction when moved with respect to) the corresponding coupler surface (e.g., smooth or grooved).

Ring 40 may be made of or may include a metal material such as described above for coupler 8A. Soft material 41 may be made of or may include a metal material such as described above for boot 9A. The compliance of the material of ring 40, material 41, and of the coupler may be selected so to ensure a seal between the boot and the coupler. The number of rings, and thickness and height of the rings may be selected so to ensure a seal between the boot and the coupler.

Figure 6A:
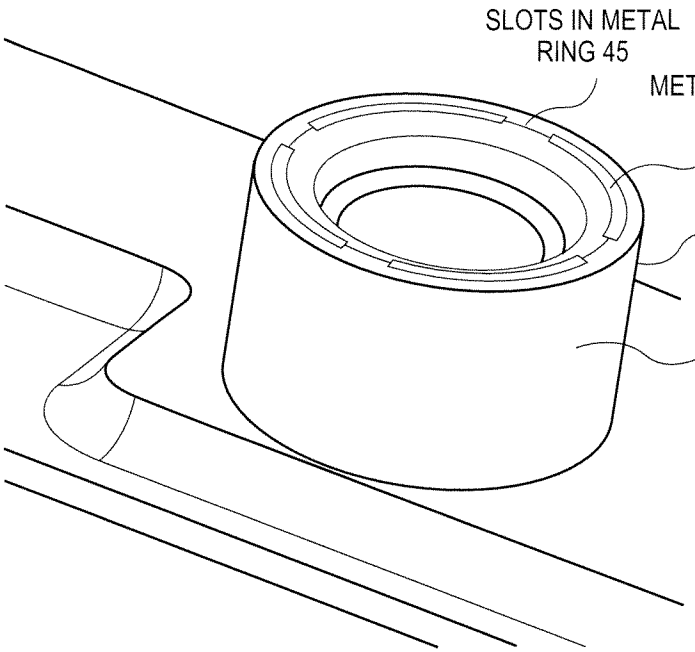
FIG. 6A is a perspective view of another type of boot.
Figure 6B:
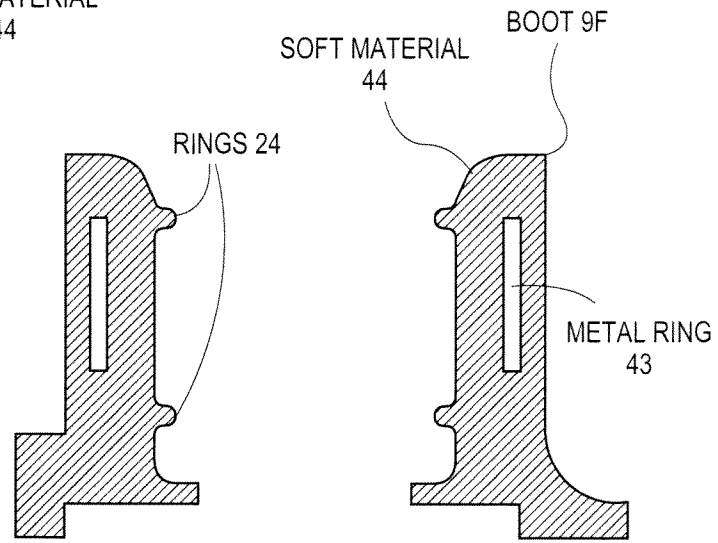
FIG. 6B is a cross-section view of FIG. 6A.

FIG. 6A is a perspective view of another type of boot. FIG. 6B is a cross-section view of FIG. 6A. Although some similar feature numbers are used for FIGS. 1-2, 5A-B and 6A-B, there is a distinction between boot 9E of FIGS. 5A-B as compared to boot 9F of FIG. 6A-B. Thus, descriptions above for couplers and boots of FIGS. 1-2 and 5A-B may apply to boot 9F and the coupler, such as with the exceptions of the differences described below. For example, as compared to boot 9E in FIG. 5A-B, in embodiments shown in FIGS. 6A-B, boot 9F includes a hard material, metal ring 43 that is overmolded on the inside surface and on the outside surface of the ring with soft material 44 that engage or form a friction seal onto the surface (e.g., smooth or grooved) of the outer perimeter of a hard coupler (e.g., coupler 8A). Boot 9F may also include rings 24, such as for engaging grooves 25 in a coupler as noted above. Ring 43 may have slots 45 that provide a rubber/metal interlock (e.g., attachment) between ring 43 and material 44 of the boot. Moreover, ring 43 may function similarly to, and may be made of or may include a similar material as ring 40. In some cases, ring 43 has a smaller diameter than ring 40, so that the boot 9F will be the same size and thickness as boot 9E, including material 44 on the outside surface of ring 43. Moreover, material 44 may function similarly to, and may be made of or may include a similar material as material 41. Thus, boot 9F may from a dirt and moisture (and possibly air) tight seal between the boot and the coupler (e.g., by sealing inner perimeter 23 to outer perimeter 26). In some embodiments, boot 9F has at least one ring that engages and seals to the coupler, such as by increasing the nominal interference with (e.g., causing friction when moved with respect to) the corresponding coupler surface (e.g., smooth or grooved).

The compliance of the material of ring 43, material 44, and of the coupler may be selected so to ensure a seal between the boot and the coupler. The number of rings, and thickness and height of the rings may be selected so to ensure a seal between the boot and the coupler.

Figure 7A:
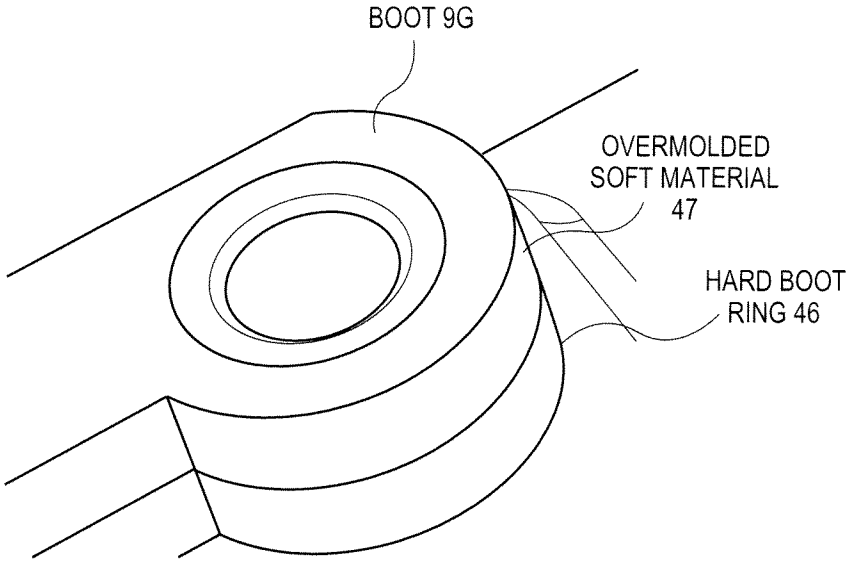
FIG. 7A is a perspective view of another type of boot.
Figure 7B:
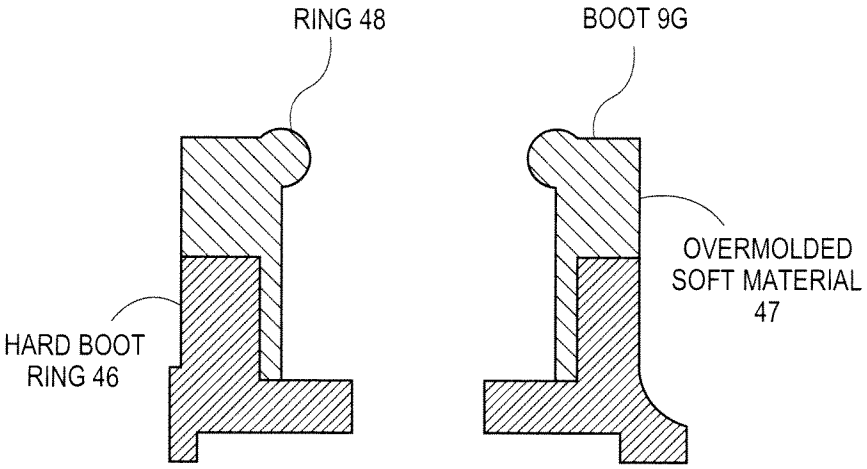
FIG. 7B is a cross-section view of FIG. 7A.

FIG. 7A is a perspective view of another type of boot. FIG. 7B is a cross-section view of FIG. 7A. Although some similar feature numbers are used for FIGS. 1-2, there is a distinction between the engaging or mating of boot 9G of FIGS. 7A-B (e.g., and the coupler) as compared to couplers and boots of FIGS. 1-2. Thus, descriptions above for couplers and boots of FIGS. 1-2 may apply to boot 9G and the coupler, such as with the exceptions of the differences described below. For example, as compared to rings 24 and grooves 25 in FIG. 1, and as compared to disc shape 30 and groove 32 of FIG. 2, in embodiments shown in FIGS. 7A-B, boot 9G includes a ring of hard material 46 around a boot of soft material (e.g., overmolded silicon or rubber) on the inside surface of the ring (e.g., but not the outside surface of the ring) that engages or forms a friction seal onto the surface (e.g., smooth or grooved) of the outer perimeter of a hard coupler (e.g., coupler 8A with our without a groove 25). The ring 46 of hard material (example metal) maintains a high hoop stresses around the outer perimeter of the boot of soft material 47. Boot 9G may also have upper ring 48 to restrain or maintain the coupler within the boot. Rings 48 may engage a groove 25 in a coupler as noted above. Ring 46 may have a rubber/metal interlock (e.g., attachment) with material 47 of the boot. Moreover, ring 46 may provide additional support, constriction towards, and resistance against expansion of the coupler, thus causing a tighter or more forceful seal (e.g., friction) between the boot and coupler. This may from a dirt and moisture (and possibly air) tight seal between the boot and the coupler (e.g., by sealing inner perimeter 23 to outer perimeter 26). In some embodiments, boot 9G has ring 46 around it's perimeter that engage and seal to the coupler, such as by increasing the nominal interference with (e.g., causing friction when moved with respect to) the corresponding coupler surface (e.g., smooth or grooved).

Ring 46 may be made of or may include a metal material such as described above for coupler 8A. Soft material 44 may be made of or may include a metal material such as described above for boot 9A. The compliance of the material of ring 46, material 44, and of the coupler may be selected so to ensure a seal between the boot and the coupler. The thickness and height of the ring may be selected so to ensure a seal between the boot and the coupler.

Figure 8:
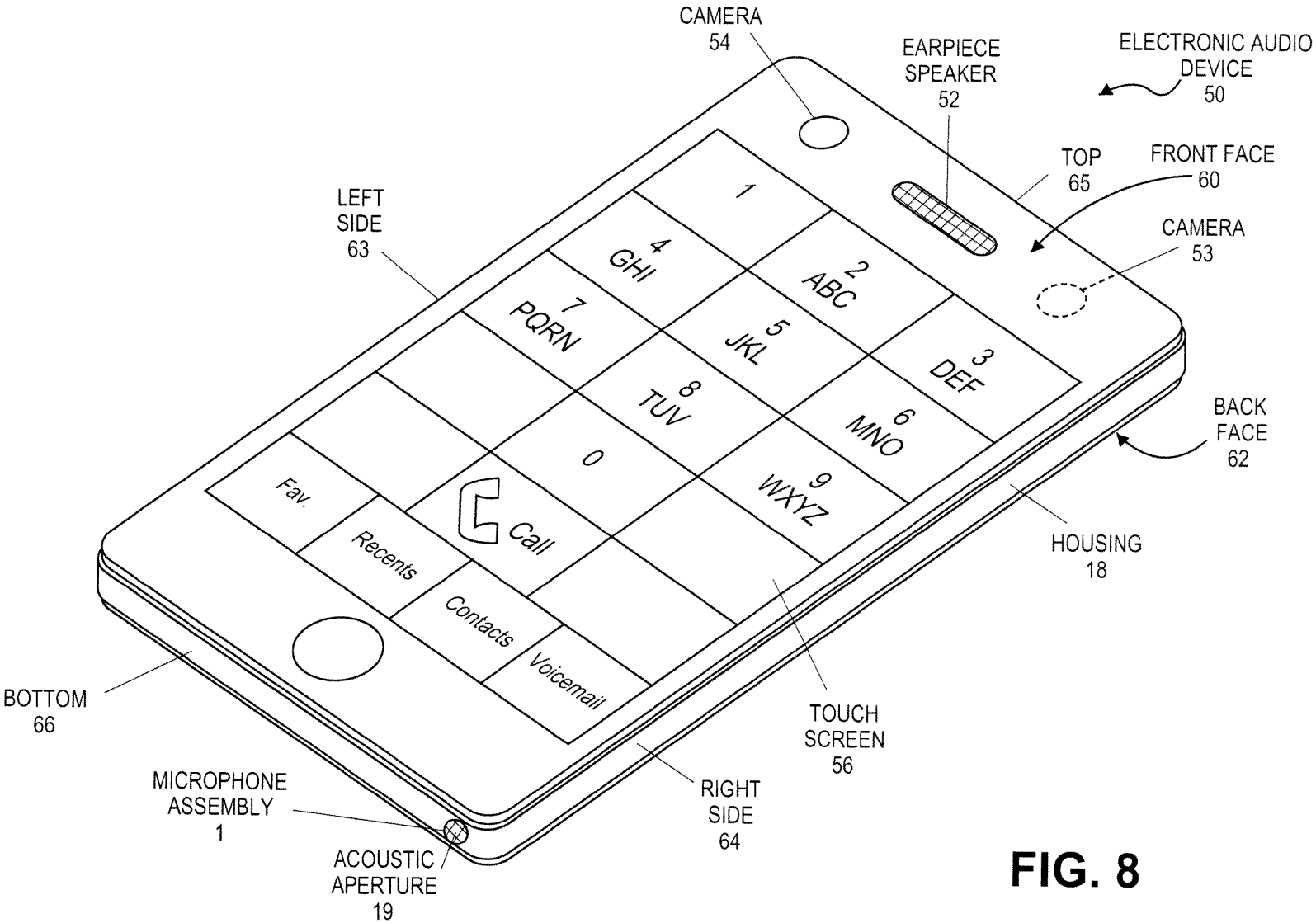
FIG. 8 depicts an example electronic device into which embodiments of the microphone assembly may be installed.

In addition, by forming seals between housing 18, the boot, the coupler, carrier 2 and microphone 4, assembly 1 provides a seal with respect to air and dust, as well as sound isolation between the ambient, outside of acoustic aperture 19 and spaces, components and circuitry within housing 18 (e.g., within device 50 of FIG. 8). These seals may provide sufficient sound isolation (e.g., muffling or deadening) between stray or unwanted sound in the ambient, outside of acoustic aperture 19 and spaces, components and circuitry within housing 18. For example, desired sound waves may be directionally detected within an acceptance angle of the axis of the assembly acoustic apertures, but stray or unwanted sound in the ambient outside of the acceptance angle may be isolated. Such isolation may isolate the audio output of a speaker of the device (e.g., within device 50 of FIG. 8), such as to avoid feedback. Similarly, the softness of boot 9B may (e.g., material may be selected softness) provide audio vibration isolation between the microphone and the housing, such as to isolate device vibration from the audio output of a speaker causing feedback at the microphone.

In some cases, the seals between housing 18, the boot, the coupler, carrier 2 and microphone 4 prevent ambient moisture and dirt (e.g., dust) from entering the device through aperture 19. For example, these seals may reduce or eliminate gaps between the ambient and inside of the device. Such gaps may include breaks or openings through pairs of components of the assembly, between the ambient and spaces/components inside of the device housing, other than the acoustic apertures of the assembly and the microphone input. Thus, these seals reduce or eliminate the chances that ambient moisture and dirt will cause unwanted signals (e.g., due to buildup causing unwanted increases or decreases in resistance; shorts or open circuits) or other damage to the microphone or other component and circuitry of the device. For example, this helps avoid moisture and dirt causing the microphone or microphone circuitry to fail or become unusable for converting verbal input by a user or other desired audio signals into electronic audio signals.

Also, cosmetic mesh 17 may assist in reducing or filtering out incident dust from entering opening 12, providing a partial or total dust seal between the ambient, outside of acoustic aperture 19 and opening 12. Acoustic mesh may also provide such a partial seal. Either or both of these meshes may reduce dust buildup within openings 12, 10, and 3; and upon microphone 4. This may reduce an amount of dust that resides on microphone 4, improving the response and life of the microphone.

FIG. 8 shows an example electronic device 50 and circuitry into which embodiments of the microphone assembly can be installed or integrated. Generally, device 50 may represent a personal computer, business computer or other electronic communications device (e.g., a mobile telephone) that allows two-way real-time conversations (generally referred to as calls) between a near-end user and a far-end user. The particular example of FIG. 8 is a smart phone having an exterior housing 18 that is shaped and sized to be suitable for use as a mobile telephone handset. Thus, device 50 allows two-way real-time conversations (generally referred to as calls) between a near-end user holding the device 50 against her ear, or using speaker mode, and a far-end user. There may be a connection over one or more communications networks between the device 50 and a counterpart device of the far-end user. Such networks may include a wireless cellular network or a wireless local area network as the first segment, and any one or more of several other types of networks such as transmission control protocol/internet protocol (TCP/IP) internetworks and plain old telephone system networks.

For example, the housing may include audio electronic circuitry and other components that interface with the speaker 52 and the microphone assembly 1, such as during a telephone call. The call may include sending video taken with an imaging system that is synchronized with audio received by microphone assembly 1. The call may be conducted by establishing a connection through a wireless network, with the help of RF communications circuitry coupled to an antenna that are also integrated in the housing of the device 50. Device 50 may allow two-way calls between a near-end user whose speech is converted by the microphone of the phone, and a far-end user whose speech is converted by a microphone of the far-end user's phone (e.g., to perform telephone video conferencing or chatting).

Device 50 of FIG. 8 includes housing 18, touch screen 56, microphone assembly 1, and ear-piece 52. One or more imaging systems may also be installed into device 50. For example, device 50 is shown having camera 53, mounted to capture images of objects below the bottom surface of housing 18. In some cases, device 50 has camera 54 mounted to capture images of objects above the top surface of housing 18. It is also possible for device 50 to have both, camera 53 and 54. Housing 18 of device 50 may include front face 60 and opposing back face 62, which are joined by sides of the device. For example, FIG. 8 shows them joined by left side 63, right side 64, top 65 and bottom 66. Front face 60 may include touch screen 56 and may include various materials such as rigid plastic, metal and/or glass. Back face 62, left side 63, right side 64, top 65 and bottom 66 may include various materials such as rigid plastic and/or metal.

According to embodiments, one or more of microphone assembly 1 may be installed or integrated into device 50. During a telephone call, the near-end user may listen to the call using an earpiece speaker 52 located within the housing of the device and that is acoustically coupled to an acoustic aperture formed near the top of the housing. The near-end user's speech and/or other audio signals may be picked up by microphone assembly 1 (e.g., microphone 4) whose acoustic port 7 is aligned with aperture 19, which may be located along a side of housing 18. In some cases, assembly 1 (e.g., microphone 4 and opening 12) may be facing towards left side 63, right side 64, top 65 or bottom 66. This may include having opening 12 aligned with aperture 19 formed in a surface of left side 63, right side 64, top 65 or bottom 66.

For example, FIG. 8 shows device 50 is shown having microphone assembly 1, such as an assembly having acoustic aperture 19 to allow audio signals 30 to be received by microphone 4 (e.g., mounted below the bottom surface of housing 18). As shown in FIG. 8, embodiments may include cosmetic mesh 17 exposed within acoustic aperture 19. The microphone assembly 1 can have its circuitry in a stand-alone component (e.g., a module including assembly 1 and having electronic connectors); or can have its circuitry incorporated into circuitry of other electronic components of the device. Microphone assembly 1 may be an acoustic-to-electric transducer or sensor that converts sound into an electrical signal. The electrical signal may be stored (e.g., in volatile or non-volatile electronic memory within the device) and/or transmitted via SMS, email, or phonecall by device 50.

A user may interact with the device 50 by way of a touch screen 56 that is formed in the front exterior face or surface of the housing. The touch screen may be an input and display output for the device. The touch screen may be a touch sensor (e.g., those used in a typical touch screen display such as found in an iPhone™ device by Apple Inc., of Cupertino Calif.). As an alternative, embodiments may use a physical keyboard may be together with a display-only screen, as used in earlier cellular phone devices. As another alternative, the housing of the device 50 may have a moveable component, such as a sliding and tilting front panel, or a clamshell structure, instead of the chocolate bar type depicted.

In some embodiments of the present invention, device 50 may be described in the general context of a "system" or "electronic audio device", such as a portable electronic device or mobile phone that includes microphone assembly 1. Device 50 may include a processor and a memory unit operatively connected to the processor, the memory unit including software computer program instructions for operations of the device. 18. The processor may be able to execute the software instructions to operate the device. The device may also includes RF communications circuitry coupled to an antenna and the processor, such that the RF communications circuitry is able to communicate telephone calls. In this device, the microphone assembly may be coupled to microphone circuitry, which is coupled to the processor and which processes the electrical audio signal output of the microphone. In some cases, the device has a device housing including a front face, a back face and sides attaching the front face to the back face. The front face may have a touch screen input/output. Also, an opening of the microphone assembly may face and be open to an aperture through one of the sides of the housing (e.g., the bottom or a side).

Is it considered that embodiments of microphone assembly 1 can be integrated into a wide variety of electronic devices such as desktop computers, personal digital assistants, personal computers, and other mobile and non-mobile devices (e.g., security systems, and mounted microphones). In some embodiments, microphone assembly 1 is mounted in a bottom edge or side edge of a desktop computer housing; or of mobile device housing, such as of a cell phone, tablet computer, notebook computer, or PDA.

The microphone assemblies described herein may be designed and/or sold by electronic device manufacturers, such as manufacturers of a computer, a telephone handset, a "source device" or a "host device" that can detect audio signals as described herein. They may also be designed and/or sold by headset manufacturers, such as manufacturers of an audio headset or other headset having a microphone of a "headset" or "headphone" device that can detect audio signals as described herein.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the microphone assembly has been described in connection with the embodiments of FIG. 8, a similar microphone assembly can be integrated into other electronic audio devices such as mobile recorders, and video cameras.

What is claimed is:

1. An electronic device comprising:

a microphone assembly having:

a printed circuit carrier having a first opening;

a microphone having an acoustic input port aligned with the first opening and that faces a back side of the carrier;

a rigid acoustic coupler having a round outer surface formed around an outer perimeter of the rigid coupler and having a second opening that is aligned with the first opening; and a compliant boot having a round inner surface formed around an inner perimeter of the compliant boot and installed over the outer surface of the rigid acoustic coupler, wherein a seal is formed between the round inner surface of the compliant boot and the round outer surface of the ridged acoustic coupler.

2. The electronic device of claim 1, wherein the microphone is bonded to the back side of the carrier; and wherein the coupler is bonded to the front side of the carrier.

3. The electronic device of claim 1, wherein the microphone is soldered to the back side of the carrier, the rigid acoustic coupler is soldered to the front side of the carrier, and the carrier is a flex circuit carrier.

4. The apparatus of claim 1, wherein the rigid acoustic coupler comprises a metal cap and the compliant boot comprises a soft compression molded material.

5. The apparatus of claim 4, wherein the seal comprises at least one of: a ring in the round inner surface of the boot that engages a groove formed in the round outer surface of the coupler, at least one ring in the round inner surface of the boot, at least one thread formed in the round outer surface of the coupler, at least one O-ring between the round inner surface of the boot and the round outer surface of the coupler, a metal ring in the boot and surrounding the round outer surface of the coupler, or a hard material in the boot and surrounding the round outer surface of the coupler.

6. The electronic device of claim 1, further comprising:

a mobile housing in which the microphone assembly is installed, wherein the second opening faces an acoustic aperture through a bottom or side of the mobile housing.

7. The electronic device of claim 6, wherein the microphone assembly is attached to a support structure within the mobile housing; and wherein the boot is bonded to edges of an aperture of the mobile housing.

8. A mobile device having a microphone assembly, the assembly comprising:

a printed circuit carrier having a first opening through the printed circuit carrier;

a microphone attached to and facing a back side of the carrier, the microphone having an acoustic input port aligned with the first opening;

a rigid acoustic coupler attached to and facing a front side of the carrier, the rigid acoustic coupler having a round outer surface formed around an outer perimeter of the rigid coupler and having a second opening through the coupler that is aligned with the first opening; and a compliant boot having a round inner surface formed around an inner perimeter of the compliant boot and installed over the rigid acoustic coupler, wherein a seal is formed between the round inner surface of the compliant boot and the round outer surface of the ridged acoustic coupler.

9. The apparatus of claim 8, wherein the compliant boot has a third opening through the boot and aligned with the first opening;

wherein the second opening extends from the front side of the coupler to the first opening; and wherein the third opening extends from the front side of the boot to the second opening.

10. The apparatus of claim 8, wherein the compliant boot is attached to a device housing with an adhesive;

wherein the third opening is aligned with an acoustic aperture of the housing; and further comprising:

a cosmetic mesh over the third opening and attached to the front side of the boot with an adhesive;

an acoustic mesh under the cosmetic mesh, over the third opening and attached to the front side of the boot with an adhesive.

11. The apparatus of claim 8, wherein the microphone is soldered to the back side of the carrier, the rigid acoustic coupler is soldered to the front side of the carrier, and the compliant boot is sealed to the rigid acoustic coupler.

12. The apparatus of claim 8, wherein the seal comprises at least one of: a ring in the round inner surface of the compliant boot that engages a groove formed in the round outer surface of the coupler, at least one ring in the round inner surface of the boot, at least one thread formed in the round outer surface of the coupler, at least one O-ring between the boot and the round outer surface of the coupler, a metal ring in the boot and surrounding the round outer surface of the coupler, or a hard material in the boot and surrounding the outers surface of the coupler.

13. The apparatus of claim 8 wherein the rigid acoustic coupler comprises a metal cap, and the compliant boot comprises a soft compression molded material.

14. The apparatus of claim 8, wherein the compliant boot does not touch the printed circuit carrier; and wherein audio signals incident upon the front side of the compliant boot are converted by the microphone into analog audio electrical signals transmitted through electrical traces of the printed circuit carrier.

15. The apparatus of claim 8, wherein the microphone is secured to and sealed to the back side of the printed circuit carrier by a soldering process or glue; and wherein the coupler is secured to and sealed to the front side of the printed circuit carrier by a soldering process or glue.

16. The apparatus of claim 8, wherein the acoustic input port of the microphone adjoins the first opening, and wherein the microphone is soldered and connected to a through signal contact on the back side of the printed circuit carrier.

17. The apparatus of claim 8, wherein the printed circuit carrier is a flexible circuit carrier; and wherein the first opening is a through opening from the front side to the back side of the printed circuit carrier.

18. The apparatus of claim 8, wherein the microphone assembly is mounted in a bottom edge or side edge of a mobile device housing; and wherein the mobile device is a cell phone, tablet computer, notebook computer, or PDA.

19. The apparatus of claim 8, wherein the microphone assembly is mounted in a bottom edge or side edge of a device housing;

and wherein the device is a desktop computer.

20. The apparatus of claim 8, wherein the microphone is disposed entirely behind a surface of the back side of the printed circuit carrier and not within the first opening of the printed circuit carrier.

21. The apparatus of claim 8, wherein the microphone is contained within an encasement or housing, and wherein the encasement or housing is outside and behind the backside of the printed circuit carrier, and external to the first opening of the printed circuit carrier.

22. An electronic audio device comprising:

a processor coupled to a memory, the processor to execute software instructions to operate the device;

RF communications circuitry coupled to an antenna and the processor, the RF communications circuitry to at least communicate a telephone call;

a microphone assembly having: a printed circuit carrier having a first opening;

a microphone having an acoustic input port aligned with the first opening and that faces a back side of the carrier;

a rigid acoustic coupler having a round outer surface formed around an outer perimeter of the rigid coupler and having a second opening that is aligned with the first opening;

a compliant boot having a round inner surface formed around an inner perimeter of the compliant boot and installed over the rigid acoustic coupler, wherein a seal is formed between the round inner surface of the compliant boot and the round outer surface of the ridged acoustic coupler; and microphone circuitry coupled to the microphone and to the processor, the microphone circuitry to process the electrical audio signal output of the microphone.

23. The electronic audio device of claim 22 further comprising:

a device housing including a front face, aback face and sides attaching the front face to the back face;

wherein the front face include a touch screen input/output;

wherein the third opening of the microphone assembly faces and is open to an aperture through one of the sides.

* * * * *